US005363755A

United States Patent [19]

Liang

[11] Patent Number: 5,363,755

[45] Date of Patent: Nov. 15, 1994

[54] COMBINATION OF UTENSILS

[76] Inventor: David Liang, 4Fl., No. 30, Lane 26, Taisun St., Taipei, Taiwan, Prov. of China

[21] Appl. No.: 235,389

[22] Filed: Apr. 29, 1994

[51] Int. Cl.[5] ..... B02C 19/20; A41J 43/25

[52] U.S. Cl. ..... 99/484; 99/352; 99/646 R; 99/357; 241/83; 241/95; 241/273.2; 269/289 R; 269/302.1

[58] Field of Search ..... 99/352, 353, 357, 484, 99/646 R; 241/83, 95, 273.1–273.4, 301; 269/289 R, 290, 302.1, 308, 309

[56] References Cited

U.S. PATENT DOCUMENTS

| | | | |
|---|---|---|---|
| 157,283 | 12/1874 | Gurney | 269/302.1 X |
| 827,894 | 8/1906 | Truman | 99/484 |
| 1,297,712 | 3/1919 | Merrill | 99/484 |
| 1,922,973 | 8/1933 | Mischanski | 241/273.1 |
| 2,452,445 | 10/1948 | Ericsson | 269/296 |
| 2,550,896 | 5/1951 | Wickner | 241/95 X |
| 3,416,584 | 12/1968 | Rowley | 241/95 |
| 4,017,063 | 4/1977 | Brusich | 269/302.1 |
| 4,243,184 | 1/1981 | Wright | 241/273.2 |
| 4,653,737 | 3/1987 | Haskins et al. | 269/289 R |
| 4,907,789 | 3/1990 | Tice | 269/289 R |

*Primary Examiner*—Timothy F. Simone

*Attorney, Agent, or Firm*—Ross, Howison, Clapp & Korn

[57] ABSTRACT

A combination of utensils including a table defining an upperside and an underside. The upperside of the table defines a first recess, a second recess, a cutout being in communication with the first and second recesses, a third recess and two shaft-receiving recesses each defining a narrow entry. The table defines an aperture within the second recess. A chopping board is receivable in the first recess. A mandolin/grater is receivable in the second recess. A sharpening wheel is formed on a shaft. The sharpening wheel is pivotably receivable in the third recess as two ends of the shaft are retained in the shaft-receiving recesses. Two first flanges are formed on the underside of the table. A tool-receiving box includes two flanges formed thereon. The flanges of the tool-receiving box are engageable with the first flanges of the table so that the tool-receiving box is slidably mounted on the underside of the table. Two second flanges are formed on the underside of the table. A food-receiving box includes two flanges formed thereon. The flanges of the food-receiving box are engageable with the second flanges of the table so that the food-receiving box is slidably mounted on the underside of the table.

5 Claims, 5 Drawing Sheets

COMBINATION OF UTENSILS

BACKGROUND OF INVENTION

1. Field of Invention

The present invention relates to a combination of utensils in a kitchen.

2. Related Prior Art

Knifes, chopping boards, sharpening stones, mandolins and graters are generally disposed in various places in a kitchen. For example, knifes are disposed on a rack, which is disposed on a worksurface, or a shelf which is fixed on a wall. Chopping boards are disposed on a worksurface or hung on a wall. A sharpening stone is stored in a tool-receiving box. Mandolins and graters are stored in drawers. However, a cook frequently needs various different utensils briefly when preparing food and it is very inconvenient for him/her to either keep taking out and replacing the utensils or leave them idle on the worksurface between periods of use. Therefore, there is a long and unfulfilled need for a combination of utensils.

SUMMARY OF INVENTION

It is the primary object of this invention to provide a combination of utensils so that a cook can use and store them easily.

The primary object of the present invention is to provide a combination of utensils which includes a table with an upperside and an underside. The upperside of the table defines a first recess, a second recess, a cutout, a third recess and two shaft-receiving recesses. The first recess is in communication with the cutout. The second recess is in communication with the cutout. Each shaft-receiving recess is in communication with the third recess, and defines a narrow entry. The table further defines an aperture being in communication with the second recess. A chopping board is receivable in the first recess. A mandolin/grater is receivable in the second recess. A sharpening wheel is formed on a shaft. The sharpening wheel is pivotably receivable in the third recess as two ends of the shaft are retained in the shaft-receiving recesses. A tool-receiving box is slidably mounted on the underside of the table. A food-receiving box is slidably mounted on the underside of the table.

Food which has been processed by means of the mandolin/grater directly falls through the aperture into the food-receiving box when the mandolin/grater is received in the second recess. Food which has been chopped on the chopping board can be moved through the aperture into the food-receiving box when the mandolin/grater is removed from the second recess. Four feet project downwards from the underside of the table near four corners of the table whereby the feet stand on a worksurface. Four pads are each attached to one of the feet in order to prevent the feet from sliding on the worksurface.

Two first flanges are formed on the underside of the table. The tool-receiving box includes two flanges formed thereon. The flanges of the tool-receiving box are engageable with the first flanges of the table so that the tool-receiving box is slidably mounted on the underside of the table.

Two second flanges are formed on the underside of the table. The food-receiving box comprises two flanges formed thereon, whereby the flanges of the food-receiving box are engageable with the second flanges of the table so that the food-receiving box is slidably mounted on the underside of the table.

In another aspect of the present invention, the combination of utensils further includes two handles being slidably inserted into the table whereby the combination of utensils can be received in a sink as the handles can be mounted on the worksurface.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
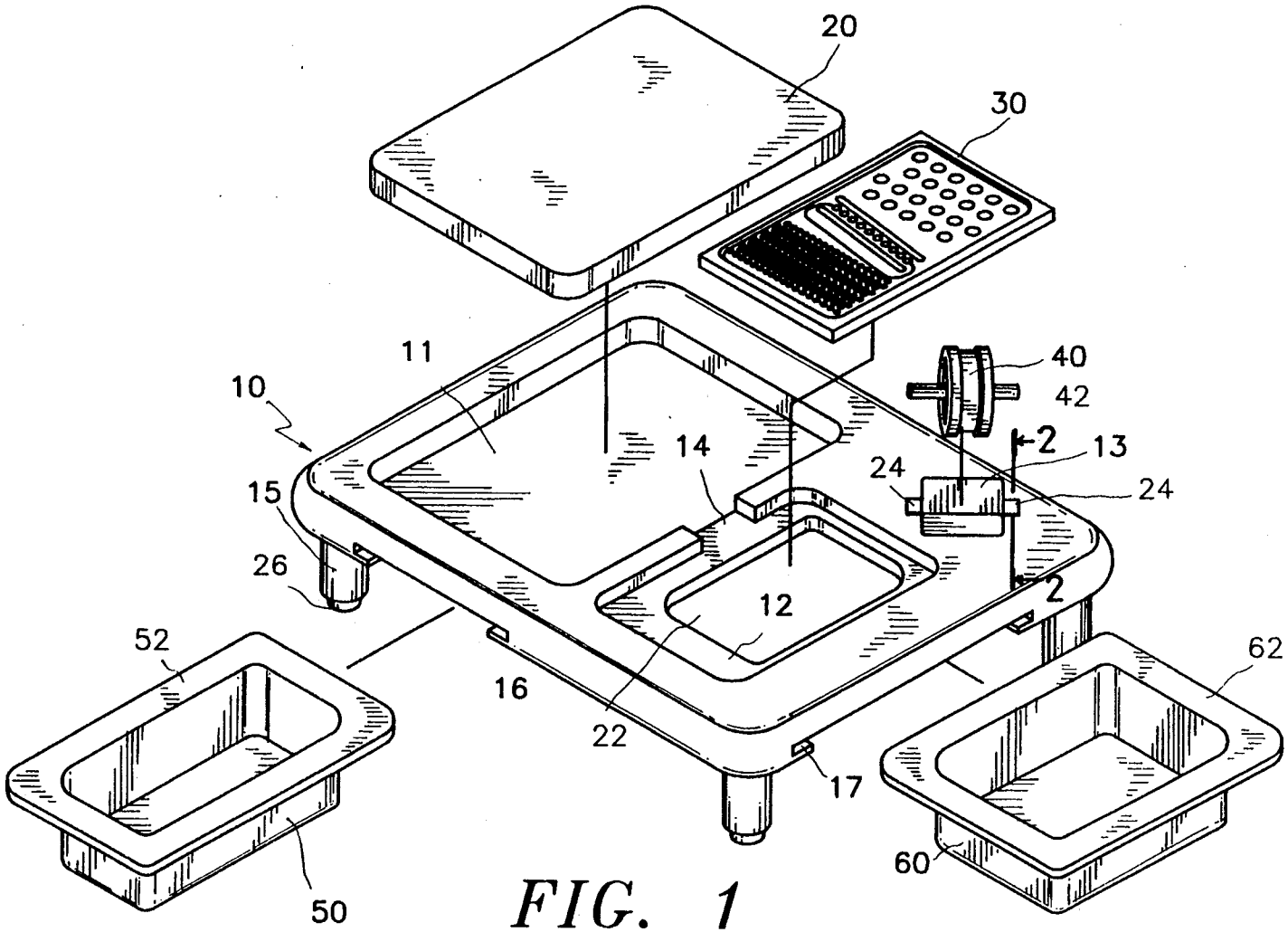
FIG. 1 is an exploded view of a combination of utensils in accordance with the preferred embodiment of the present invention.

Referring to FIG. 1, a combination of utensils includes a table 10, a chopping board 20, a mandolin/grater 30, a sharpening wheel 40, a tool-receiving box 50 and a food-receiving box 60.

The table 10 includes an upperside and an underside. The upperside of the table 10 defines a recess 11 to receive the chopping board 20. The upperside of the table 10 further defines a recess 12 in order to receive the mandolin/grater 30. To make sure that the chopping board 20 does not rattle in the recess 11, the size of the former is marginally smaller than the latter. To make sure that the mandolin/grater 30 does not slide in the recess 12, the size of the former is marginally smaller than the latter. It may be difficult for the cook to gain purchase of either the chopping board or the mandolin grater from their respective recesses 11 and 12, therefore, a cutout 14 is defined in the upperside of the table 10. The recess 11 is in communication with the cutout 14. The recess 12 is in communication with the cutout 14. It is convenient for the cook to insert one of his/her fingers into the cutout 14 in order to remove the chopping board 20 from the recess 11, and the mandolin/grater 30 from the recess 12. The table 10 defines an aperture 22 within the recess 12. The function of the aperture 22 will be described later.

Figure 2:
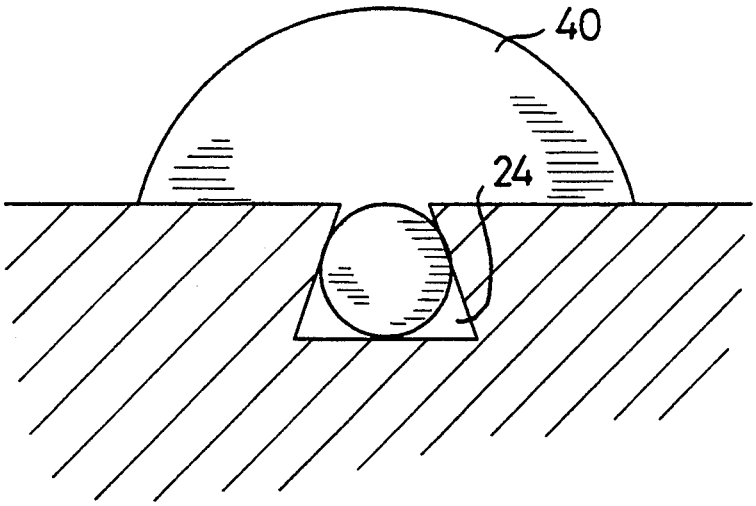
FIG. 2 is an enlarged exploded partial view of the combination of utensils shown in FIG. 1 so as to clearly show a sharpening wheel which is to be received in a recess which is defined in a table of the combination of utensils shown in FIG. 1.

Referring to FIGS. 1 and 2, the upperside of the table 10 defines a recess 13 and two recesses 24 which are in communication with the recess 13. The sharpening wheel 40 is formed on a shaft 42 which includes two ends. The sharpening wheel 40 is received in the recess 13 in a way that the ends of the shaft 42 are each received in one of two recesses 24. Each recess 24 includes a narrow entry so that the ends of the shaft 42 can be retained in the recesses 24. The sharpening wheel 40 is rotatable in the recess 13.

Four feet 15 project downwards from the underside of the table 10 near four corners of the table 10 so that the table 10 can be disposed on a worksurface (not shown). A pad 26 is attached to the end of each foot 15, thus preventing the feet 15 from sliding on the worksurface.

Figure 3:
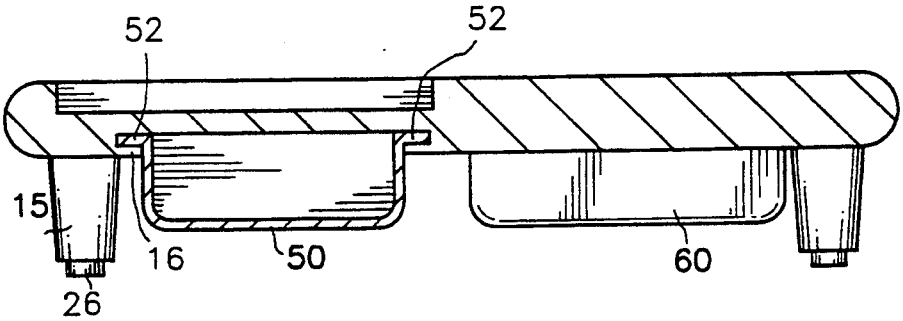
FIG. 3 is a cross-sectional view taken along a line 3—3 in FIG. 5.

Referring to FIGS. 1 and 3, two parallel flanges 16 are formed on the underside of the table 10. Two parallel flanges 52 are formed on the tool-receiving box 50. The flanges 52 are engageable with the flanges 16 so that the tool-receiving box 50 is slidably mounted on the underside of the table 10.

Figure 4:
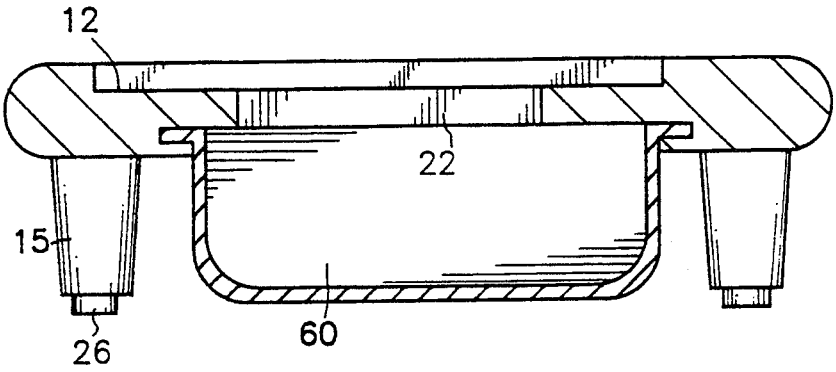
FIG. 4 is a cross-sectional view taken along a line 4—4 in FIG. 5.

Referring to FIGS. 1 and 4, two parallel flanges 17 are formed on underside of the table 10. Two parallel flanges 62 are formed on the food-receiving box 60. The flanges 62 are engageable with the flanges 17 so that the food-receiving box 60 is slidably mounted on the underside of the table 10. The food-receiving box 60 can be disposed under the table 10 in a way that the aperture 22 is in communication with the food-receiving box 60. Food can be processed by means of the mandolin/-grater 30. The food so processed falls directly through the aperture 22 into the food-receiving box 60.

Figure 5:
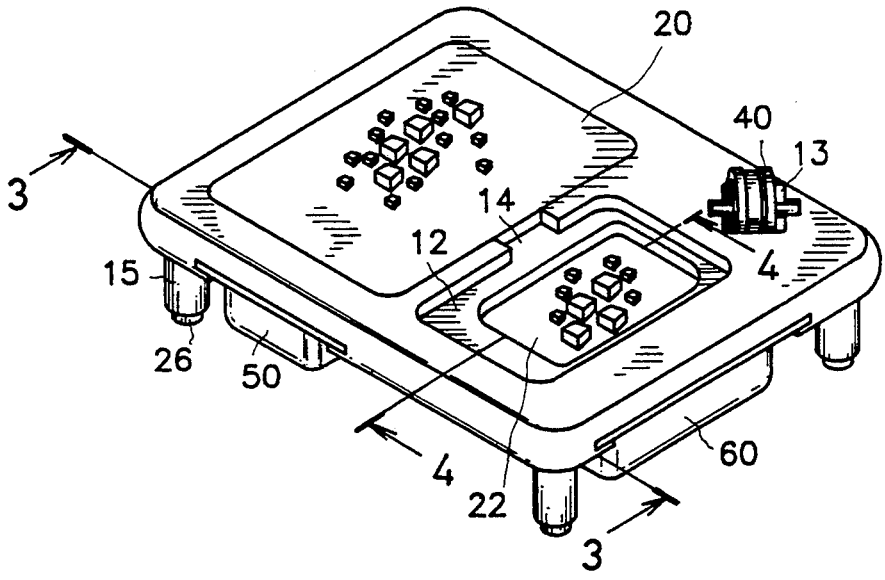
FIG. 5 is an isometric view of a combination of utensils shown in FIG. 1, but showing a mandolin-and-grater member removed.

Referring to FIG. 5, the mandolin 30 is removed from the recess 12. Food which has been chopped on the chopping board 20 can be moved from the chopping board 20 through the aperture 22 into the food-receiving box 60 so as to provide a sufficient available area of the chopping board 20.

Figure 6:
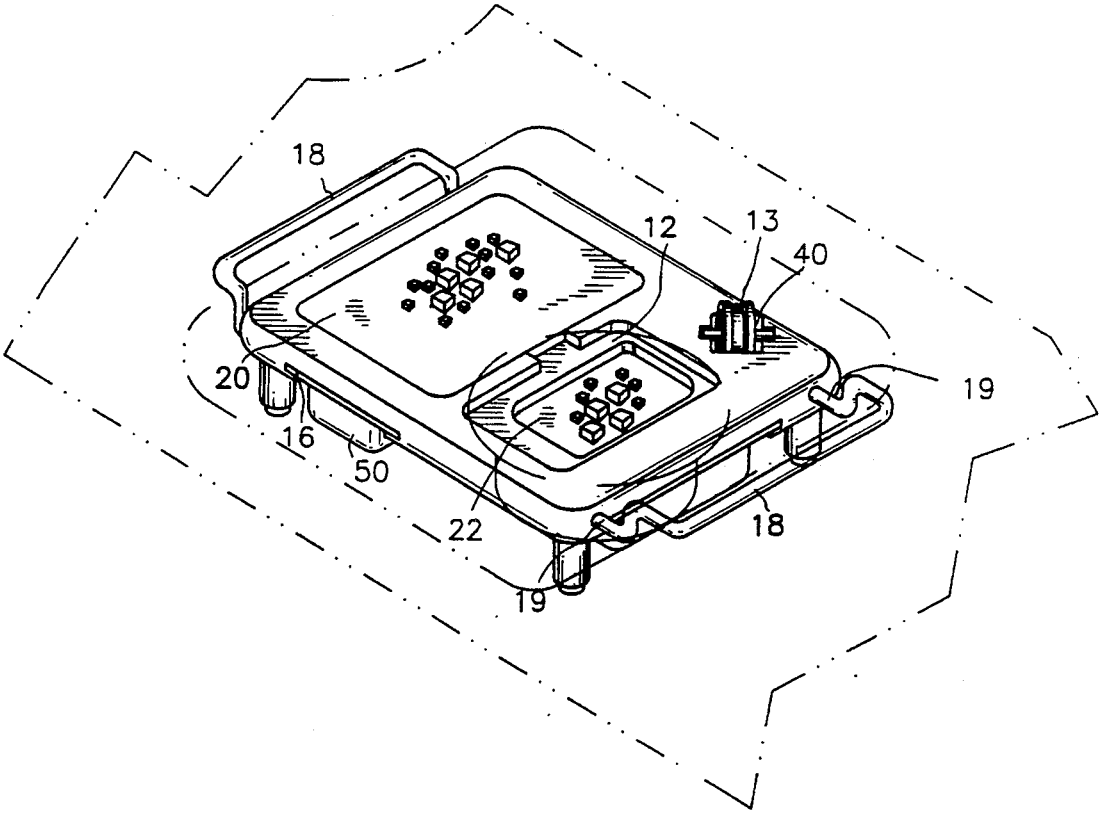
FIG. 6 is a similar view to FIG. 5, but showing the combination of utensils mounted on a sink.

Referring to FIG. 6, two handles 18 each have two inserts 19 which each project from one of two ends of the handle 18. Each insert 19 has a Z-shaped section between a first rectilinear section and a second rectilinear section. The first rectilinear section of each insert 19 is slidably inserted into one of two opposite sides of the table 10. The second rectilinear section of each insert 19 will not be inserted into the table 10 because of the curved portion of each insert 19. A cook can hold the handles 18 in order to carry the combination of utensils. Furthermore, the combination of utensils can be disposed in a sink (not shown) as the handles 18 can be mounted on the worksurface. The inserts 18 are slidably inserted into the table 10 in order to fit various sinks.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A combination of utensils comprising:

a table defining an upperside and an underside, the upperside of the table defining a first recess, a second recess, a cutout being in communication with the first and second recesses, a third recess and two shaft-receiving recesses each defining a narrow entry, the table defining an aperture within the second recess;

a chopping board being receivable in the first recess;

a mandolin/grater being receivable in the second recess;

a shaft and a sharpening wheel formed on the shaft, whereby the sharpening wheel is pivotably receivable in the third recess as two ends of the shaft are retained in the shaft-receiving recesses;

a tool-receiving box being slidably mounted on the underside of the table;

a food-receiving box being slidably mounted on the underside of the table, whereby food which has been processed by means of the mandolin/grater directly fall through the aperture into the food-receiving box when the mandolin/grater is received in the second recess, whereby food which has been chopped on the chopping board can be moved from the chopping board through the aperture into the food-receiving box when the mandolin/grater is removed from the second recess; and four feet projecting downwards from the underside of the table near four corners of the table whereby the feet stand on a worksurface.

2. A combination of utensils in accordance with claim 1 wherein the table comprises two first flanges formed on the underside thereof, wherein the tool-receiving box comprises two flanges formed thereon, whereby the flanges of the tool-receiving box are engageable with the first flanges of the table so that the tool-receiving box is slidably mounted on the underside of the table.

3. A combination of utensils in accordance with claim 1 wherein the table comprises two second flanges formed on the underside thereof, wherein the food-receiving box comprises two flanges formed thereon, whereby the flanges of the food-receiving box are engageable with the second flanges of the table so that the food-receiving box is slidably mounted on the underside of the table.

4. A combination of utensils in accordance with claim 1 comprising four pads each being attached to one of the feet in order to prevent the feet from sliding on the worksurface.

5. A combination of utensils in accordance with claim 1 comprising two handles being slidably inserted into the table whereby the combination of utensils can be received in a sink as the handles can be mounted on the worksurface.

* * * * *